US009719723B2

(12) United States Patent
Xing et al.

(10) Patent No.: US 9,719,723 B2
(45) Date of Patent: Aug. 1, 2017

(54) SUBSTRATE SUPPORT STRUCTURE, VACUUM DRYING APPARATUS AND METHOD FOR VACUUM DRYING A SUBSTRATE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Hongwei Xing, Beijing (CN); Huihui Mu, Beijing (CN); Min Yuan, Beijing (CN); Hequn Zhang, Beijing (CN); Longgen Yang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 7 days.

(21) Appl. No.: 15/088,547

(22) Filed: Apr. 1, 2016

(65) Prior Publication Data

US 2016/0320124 A1 Nov. 3, 2016

(30) Foreign Application Priority Data

Apr. 29, 2015 (CN) ..... 2015 1 0212459

(51) Int. Cl.
*F26B 5/12* (2006.01)
*F26B 25/00* (2006.01)
*F26B 5/04* (2006.01)

(52) U.S. Cl.
CPC ..... *F26B 25/004* (2013.01); *F26B 5/045* (2013.01); *F26B 5/12* (2013.01)

(58) Field of Classification Search
CPC ..... F26B 25/004; F26B 5/045; F26B 5/12; C23C 16/00; C23C 16/50
(Continued)

(56) References Cited

U.S. PATENT DOCUMENTS 5,775,000 A * 7/1998 Maekawa ..... H01L 21/68728 134/902
5,882,168 A * 3/1999 Thompson ..... H01L 21/67173 414/416.01
(Continued)

FOREIGN PATENT DOCUMENTS

CN 1855416 A 11/2006
CN 203117640 U 8/2013
(Continued)

OTHER PUBLICATIONS

First Chinese Office Action (including English translation) dated Jul. 4, 2016, for corresponding Chinese Application No. 201510212459.2.

*Primary Examiner* — Stephen M Gravini
(74) *Attorney, Agent, or Firm* — Kinney & Lange, P.A.

(57) ABSTRACT

Disclosed is a substrate support structure, a vacuum drying apparatus and a method for vacuum drying a substrate. The substrate support structure comprises: a support pin having a top end for supporting a substrate; and an auxiliary support assembly including: a drive device; a support rod driven by the drive device; and a support disc disposed at a top end of the support rod and made of flexible material adapted to support the substrate, wherein the drive device is configured to drive the support rod to move in a direction parallel to an axial direction of the support pin so as to make the support disc positioned below or above the top end of the support pin as the support rod moves, so that the substrate is selectively supported by the support disc or the support pin. The substrate support structure, the vacuum drying apparatus and
(Continued)

the method for vacuum drying a substrate can prevent the substrate from being easily scratched and avoid poor quality and uneven brightness of the substrate.

20 Claims, 4 Drawing Sheets

(58) Field of Classification Search
USPC ..... 34/78, 406; 118/728
See application file for complete search history.

(56) References Cited

U.S. PATENT DOCUMENTS 6,026,589 A * 2/2000 Yao ..... C23C 16/4583 34/228
6,269,552 B1 * 8/2001 Honda ..... H01L 21/67034 34/186
7,866,058 B2 * 1/2011 Kim ..... B23B 31/28 118/313
7,992,318 B2 * 8/2011 Kawaji ..... H01L 21/67109 118/58
8,603,249 B2 * 12/2013 Kim ..... G02F 1/1303 118/715
8,635,784 B2 * 1/2014 Ettinger ..... H01L 21/67034 271/267
9,275,847 B2 * 3/2016 Jung ..... H01L 21/00
2003/0188447 A1 * 10/2003 Nelson ..... H01L 21/67754 34/58
2016/0320124 A1 * 11/2016 Xing ..... F26B 25/004

FOREIGN PATENT DOCUMENTS

CN 203241662 U 10/2013
DE 4332674 A1 * 3/1995 ..... C23C 14/50
JP 11238673 A * 8/1999
JP 5426131 B2 * 2/2014
KR 20020057811 A * 7/2002 ..... F28D 15/02
KR 101515749 B1 4/2015
WO WO 2004057939 A2 * 7/2004 ..... B29C 65/7847

* cited by examiner

SUBSTRATE SUPPORT STRUCTURE, VACUUM DRYING APPARATUS AND METHOD FOR VACUUM DRYING A SUBSTRATE

CROSS-REFERENCE TO RELATED APPLICATION

This application claims the benefit of Chinese Patent Application No. CN201510212459.2 filed on Apr. 29, 2015 in the State Intellectual Property Office of China, the whole disclosure of which is incorporated herein by reference.

BACKGROUND OF THE INVENTION

Field of the Invention

Embodiments of the disclosure generally relate to field of mechanical equipment technique, in particularly to a substrate support structure, a vacuum drying apparatus and a method for vacuum drying a substrate.

Description of the Related Art

During manufacturing a liquid crystal display, it is necessary to vacuum dry and bake a substrate with film layers processed by a coating process. When vacuum drying and baking the substrate, a robotic arm is required to place the substrate onto a support structure. When placing the substrate by the robotic arm, a part of the substrate will firstly contact with the support structure. As the robotic arm moves downward, the substrate can be completely placed onto the support structure. When other parts of the substrate contact with the support structure, the part of the substrate firstly contacting with the substrate would slide relative to the support structure. Since a top end of the support structure is very sharp, a bottom of the substrate is easily scratched. In addition, a vibration and shifting of the robotic arm during the downward movement will also cause the bottom of the substrate to be scratched.

In order to avoid the problem as described above, as shown in FIG. 1, the substrate support in the prior art comprises a support pin 01, a top end of which is provided with a support disc 02 for supporting the substrate.

Since an area of the support disc 02 is relative large, the support disc 02 will easily contact with a pixel region when supporting the substrate, which may result in a poor quality of the substrate. In addition, marks would be easily generated on the substrate due to the contact of the support disc 02 with the substrate during baking, which may result in an uneven brightness.

SUMMARY OF THE INVENTION

Embodiments of the disclosure provide substrate support structure, a vacuum drying apparatus and a method for vacuum drying a substrate which can overcome or alleviate at least one problem in the prior art that the substrate is easily scratched by the substrate support structure, a poor quality of the substrate and an uneven brightness are generated.

According to an aspect of the disclosure, there is provided a substrate support structure comprising: a support pin having a top end for supporting a substrate; and an auxiliary support assembly including: a drive device; a support rod driven by the drive device; and a support disc disposed at a top end of the support rod and made of flexible material adapted to support the substrate, wherein the drive device is configured to drive the support rod to move in a direction parallel to an axial direction of the support pin so as to make the support disc positioned below or above the top end of the support pin as the support rod moves, so that the substrate is selectively supported by the support disc or the support pin.

According to an exemplary embodiment of the disclosure, the support pin has a cavity therein, within which the drive device is disposed; the support pin includes a side wall which is formed with an elongated slot penetrating the side wall radially and extending axially; and the support rod has a bottom end connected with the drive device, and a top portion of the support rod is extended out of the cavity through the elongated slot.

According to an exemplary embodiment, the support rod includes a main rod and a plurality of branch rods, a bottom end of the main rod being connected with the drive device, and a top end of the main rod being connected with bottom ends of the plurality of branch rods; the side wall of the support pin is formed with a plurality of the elongated slots corresponding to the plurality of branch rods, so that the plurality of branch rods are extended out of the cavity through the respective elongated slots, with top ends of the plurality of branch rods being located in a same plane; and the support disc includes a plurality of support discs, the plurality of support discs being disposed on the respective top ends of the plurality of branch rods.

According to an exemplary embodiment, the plurality of branch rods are uniformly distributed in a circumferential direction of the main rod.

According to an exemplary embodiment, the support disc includes a vacuum chuck connected with a vacuum generator, wherein when an adsorption surface of the vacuum chuck approaches a surface of the substrate, the vacuum generator draws off air between the adsorption surface of the vacuum chuck and the surface of the substrate so that vacuum is generated between the adsorption surface of the vacuum chuck and the surface of the substrate to adsorb the substrate, or the vacuum generator feeds air between the adsorption surface of the vacuum chuck and the surface of the substrate so that the vacuum therebetween is released to remove the substrate.

The flexible material may include rubber.

According to an exemplary embodiment, the top end of the support spin is formed in a cone shape.

According to an exemplary embodiment, the substrate support structure further comprising a control system configured to control the drive device so as to drive the support rod to move upward or downward in the direction parallel to the axial direction of the support pin.

According to second aspect of the disclosure, there is provided a vacuum drying apparatus comprising a support platform, a surface of which is provided with at least one substrate support structure according to the first aspect.

According to yet another aspect of the disclosure, there is provided a method for vacuum drying substrates by the vacuum drying apparatus of the second aspect, the method comprising: controlling the drive device of each substrate support structure to drive each support rod to move until the respective support discs are located in a same plane, which is above a plane in which the top ends of the respective support pins are located;

placing the substrate to be vacuum dried onto the support discs of each support structure;

controlling the drive device of each substrate support structure to drive each support rod to move downward by a same distance until the plane in which the respective support discs are located is below the plane in which the top ends of the respective support pins are located, such that the substrate to be vacuum dried falls on the top end of each support pin; and starting the vacuum drying apparatus to vacuum dry the substrate located on the top end of each support pin.

BRIEF DESCRIPTION OF THE DRAWINGS

The above and other features of the present invention will become more apparent by describing in detail exemplary embodiments thereof with reference to the accompanying drawings, in which.

Figure 1:
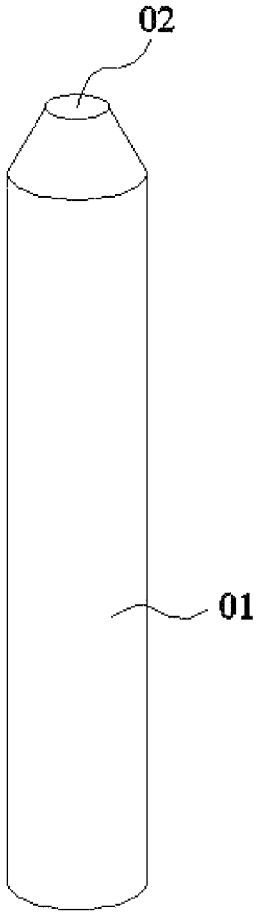
FIG. 1 is a schematic view of a substrate support structure in the prior art.

| Reference numerals: | | | | | |
|---|---|---|---|---|---|
| 1 | support pin | 11 | Cavity | 12 | elongated slot |
| 2 | drive device | 3 | support rod | 31 | main rod |
| 32 | branch rod | 4 | support disc | 5 | control system |

DETAILED DESCRIPTION OF PREFERRED EMBODIMENTS OF THE INVENTION

Embodiments of the disclosure will be clearly and completely described hereinafter with reference the accompanying drawings. Obviously, the described embodiments are merely part of the embodiments of the disclosure, rather than all of the embodiments of the disclosure. Based on the embodiments of the present invention, other embodiments acquired by the person skilled in the art without any inventive steps will be within the scope of the disclosure.

In the description of the disclosure, it should be understood that terms for indicating an orientation or position relationship such as "center", "upper", "lower", "front", "back", "left", "right", "vertical", "horizontal", "top", "bottom", "inner", "outer" are based on the orientation or position relationship shown in the accompanying drawings, and are merely for describing the invention easily and simply. Thus, these terms are not intended to indicate or suggest that a device or element must have a particular orientation and should be constructed and operated at the particular orientation. These terms are therefore cannot be interpreted as limiting the scope of invention.

In the description of the disclosure, it is noted that terms "mount", "connect", "couple" should be interpreted broadly. For example, in terms of "connect", it may be a fix connection, a detectable connection, or an integral connection; it may be a mechanical connection or an electrical connection; it may be a direct connection, an indirect connection via an intermediate medium, or an internal communication between two elements, unless stated otherwise specifically. Those skilled in the art should understand the particular meanings of the above terms based on the particular situations described herein.

In the description of the disclosure, the term "a plurality of" refers to two or more, and the term "at least one" refers to one or more, unless stated otherwise.

Figure 2:
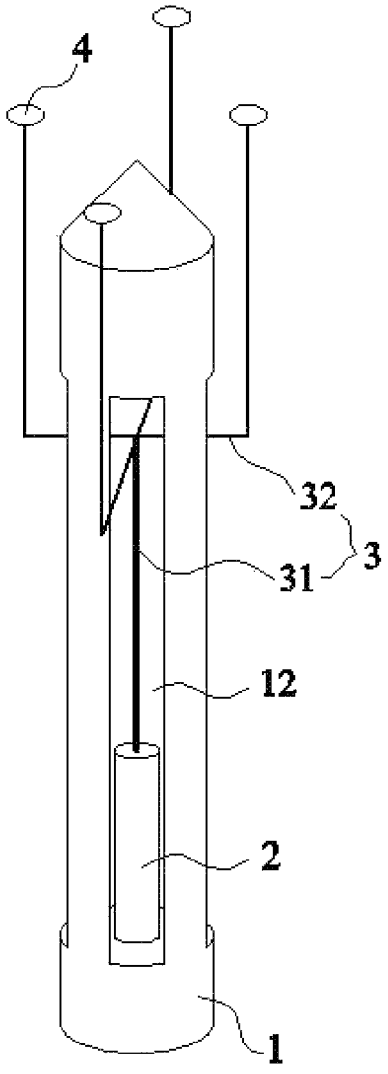
FIG. 2 is a schematic view of a substrate support structure according to an exemplary embodiment of the disclosure.

According to an embodiment of the disclosure, there is provided a substrate support structure, as shown in FIG. 2, comprising a support pin 1 having a top end for supporting a substrate; and an auxiliary support assembly including a drive device 2 connected with a support rod 3, and a top end of the support rod 3 is provided with a support disc 4 made of flexible material. The drive device 2 may drive the support rod 3 to move in a direction parallel to the support pin 1. The support disc 4 may be positioned higher or lower than the top end of the support pin 1 as the support rod 3 moves.

With the above substrate support structure, because the auxiliary support assembly is provided, when a substrate is to be placed onto the top end of the support pin 1, the drive device 2 drives the support rod 3 to move in the direction parallel to the support pin 1 until the support disc 4 is higher than the top end of the support pin 1. At this time, the substrate can be placed onto the support disc 4. Since the support disc 4 is made of flexible material, it is possible to prevent the substrate from being scratched when the substrate slides relative to the support disc 4. After that, the drive device 2 drives the support rod 3 to move in an opposite direction. When the support disc 4 is located in a same level as the top end of the support pin 1, the substrate can smoothly contact the top end of the support pin 1, thereby preventing the substrate from sliding relative to the top end of the support pin 1, which in turn avoids the substrate from being scratched. Thereafter, the drive device 2 continues to drive the support pin 1 to move until the support disc 4 is lower than the top end of the support pin 1, which can prevent the support disc 4 from contacting the substrate when the substrate is vacuum dried or baked, thereby avoiding poor quality and uneven brightness of the substrate because the support disc 4 contacts pixel regions. When the substrate is to be removed, the drive device 2 drives the support rod 3 to move in the direction in parallel to the support pin 1. Then, when the support disc 4 is located in the same level as the top end of the support pin 1, the support disc 4 is brought into contact with the substrate and allows the substrate to leave the top end of the support pin 1 smoothly, which prevents the substrate from sliding relative to the top end of the support pin 1, thereby avoiding the substrate from being scratched. Thus, the substrate support structure according to the embodiment of the disclosure can not only avoid the substrate from being scratched but also avoid poor quality and uneven brightness of the substrate.

Figure 3:
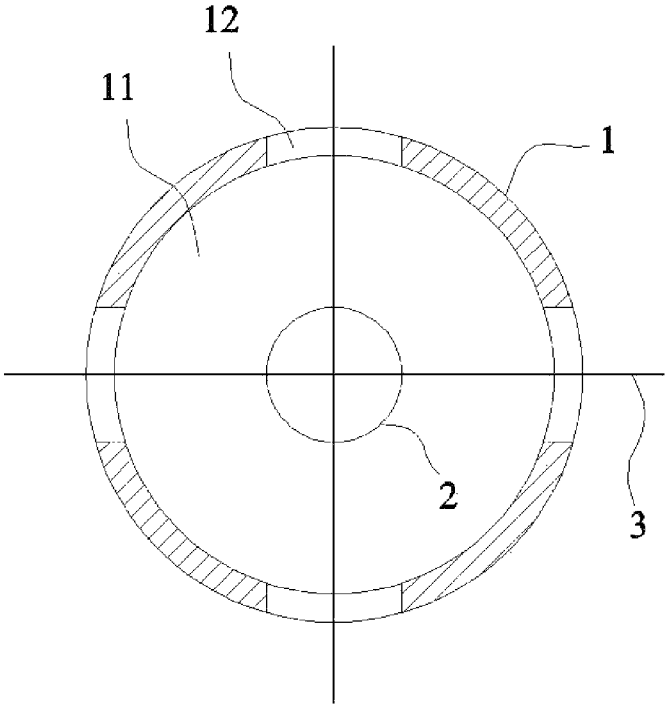
FIG. 3 is a cross-section view of the substrate support structure of FIG. 2.

In order to obtain a compact substrate support structure, referring to FIGS. 2 and 3, a cavity 11 is formed inside the support pin 1, and the drive device 2 is disposed within the cavity 11. A side wall of the support pin 1 is provided with elongated slots 12 penetrating radially therethrough and extending lengthwise in an axial direction of the support pin 1. A bottom end of the support rod 3 is connected with the drive device 2, and the top portion of the support rod 3 is configured to extend out of the cavity 11 through the elongated slots 12. Therefore, it is possible to make good use of an interior space of the support pin 1, thereby improving the compactness of the substrate support structure and saving an occupying space.

Further, referring to FIG. 2, the support rod 3 includes a main rod 31 and a plurality of branch rods 32. A bottom end of the main rod 31 is connected with the drive device 2, and a top end of the main rod 31 is connected with bottom ends of the plurality of branch rods 32. A plurality of elongated slots 12 are formed in the side wall of the support pin 1 corresponding to the plurality of branch rods 32. Top portions of the plurality of branch rods 32 protrude out of the cavity 11 through the plurality of elongated slots 12, respectively. The top ends of the plurality of branch rods 32 are located in a same plane. The support disc 4 may include a plurality of support discs. The plurality of support discs 4 are disposed at the respective top ends of the plurality of branch rods 32 correspondingly. Therefore, the substrate is stable during the movement by means of the support of the plurality of support discs 4. When the substrate contacts the top end of the support pin 1, it is possible to prevent the substrate from sliding on the top end of the support pin 1, thereby preventing the substrate from being scratched.

The plurality of branch rods 32 may be distributed uniformly in a circumferential direction of the main rod 31. Thus, the substrate is subject to uniform supporting force and the stability of the substrate during movement can be further improved.

In order to prevent the substrate from dropping during the movement along with the support disc 4, the support disc 4 may be a vacuum chuck connected with a vacuum generator (not shown). When the substrate is placed onto the vacuum chuck, an adsorption surface of the vacuum chuck will contact a surface of the substrate. At this time, air between the adsorption surface of the vacuum chuck and the surface of the substrate may be drawn off by the vacuum generator so that vacuum is generated between the adsorption surface of the vacuum chuck and the surface of the substrate, thereby preventing the substrate from slipping during the movement along with the support disc 4. Conversely, when it is necessary to remove the substrate, air is fed between the adsorption surface of the vacuum chuck and the surface of the substrate by the vacuum generator so that the vacuum between the adsorption surface of the vacuum chuck and the surface of the substrate is released so as to remove the substrate easily.

In order reduce manufacturing cost of the substrate support structure, the flexible material may include rubber which is relatively soft and can avoid the substrate from being scratched when it is brought into contact with the substrate. Further, the rubber is inexpensive and can reduce the manufacturing cost of the substrate support structure.

Referring to FIG. 2, the top end of the support spin 1 is formed in a cone shape, which can reduce a contact area between the support pin 1 and the substrate, thereby the quality of the substrate will not be affected because the support pin 1 contacts pixel regions.

In addition, the support disc 4 may be detachably connected to the top end of the support rod 3. Thus, when the support disc 4 is broken, it is possible to directly replace the support disc 4, thereby reducing a maintenance cost of the substrate support structure.

Figure 4:
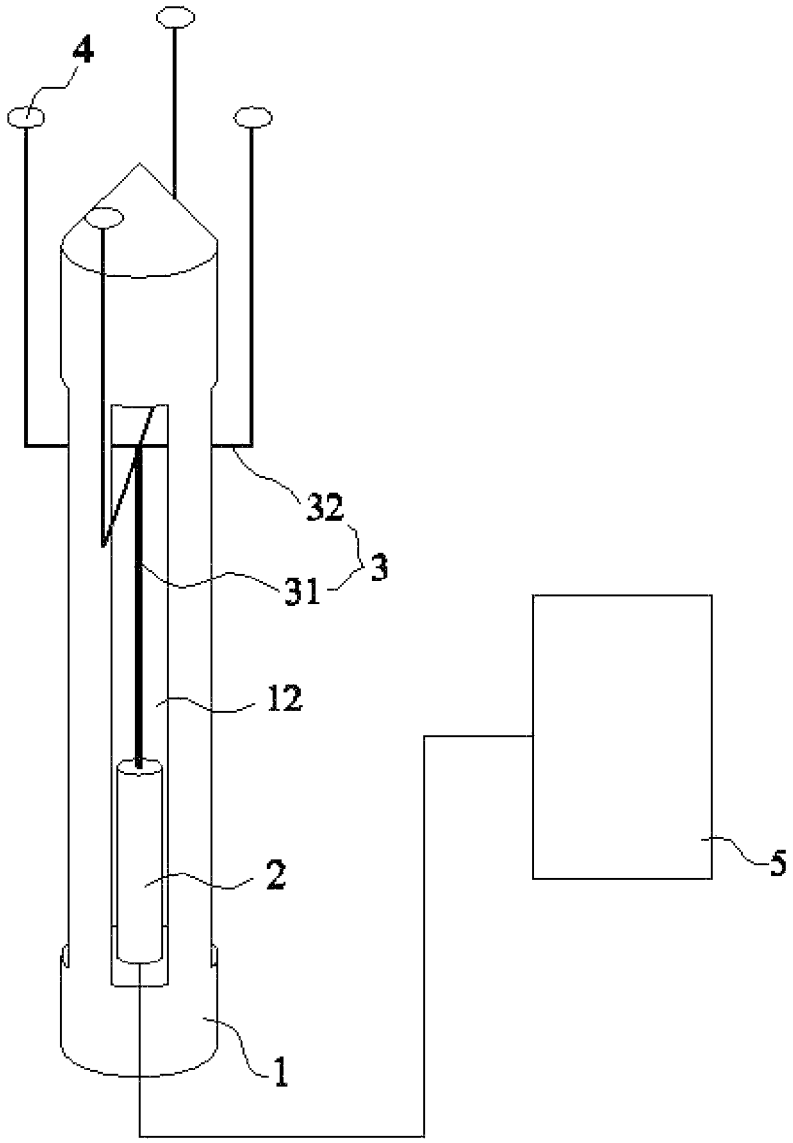
FIG. 4 is a schematic view showing a control system connected with the drive device of the substrate support structure shown in FIG. 2.

Referring to FIG. 4, the substrate support structure according to an embodiment of the disclosure further comprises a control system 5. The control system 5 is connected with the drive device 2 and controls the drive device 2 to drive the support rod 3 to move upward or downward in the direction parallel to the support pin 1. When it is necessary to place the substrate onto the top end of the support pin 1, the control system 5 controls the drive device 2 to drive the support rod 3 to move upward in the direction parallel to the support pin 1 until the support disc 4 are above the top end of the support pin 1. Thereafter, the control system 5 controls the drive device 2 to stop the support rod 3. At this time, it is possible to place the substrate onto the support disc 4. After that, the control system 5 controls the drive device 2 to move the support rod 3 downward in the direction parallel to the support pin 1 until the support disc 4 are positioned below the top end of the support pin 1; at this time, the control system 5 controls the drive device 2 to stop the support rod 3. In this state, when it is necessary to remove the substrate, the control system 5 controls the drive device 2 to move the support rod 3 upward in the direction parallel to the support pin 1 until the support disc 4 lifts the substrate; then, the control system 5 controls the drive device 2 to stop the support rod 3. In this way, it is possible to realize an automatic control of the substrate support structure.

Further, according to an embodiment of the invention, there is provided a vacuum drying apparatus comprising a support platform (not shown), a surface of which is provided with at least one substrate support structure as described above.

Other structures of the vacuum drying apparatus according to the embodiments of the disclosure are well-known for those skilled in the art, and description thereof in detail will be omitted herein.

A method for vacuum drying substrates by the vacuum drying apparatus as described above comprising: controlling the drive device 2 of each substrate support structure to drive each support rod 3 to move upward by a same distance until a plane in which the respective support discs 4 are located is higher than that in which top ends of the respective support pins 1 are located; placing the substrates to be vacuum dried onto the plane in which the respective support discs 4 are located; controlling each drive device 2 of the respective substrate support structure to drive each support rod 3 to move downward by a same distance until the plane in which the respective support discs 4 are located is lower than that in which the top ends of the respective support pins 1 are located, so that the substrates having been vacuum dried fall on the plane in which the top ends of the respective support pins 1 are located; and, starting the vacuum drying apparatus to vacuum dry the substrates located in the plane in which the top ends of the respective support pins 1 are located.

After starting the vacuum drying apparatus to vacuum dry the substrates located in the plane in which the top ends of the respective support pins 1 are located, the method further comprises controlling the drive device 2 of each substrate support structures to drive each support rod 3 to move upward by the same distance until the substrates having been vacuum dried are lifted by the respective support discs 4; and removing the substrates having been vacuum dried.

In the vacuum drying apparatus and the method for vacuum drying the substrates according to the embodiments of the disclosure, due to the plurality of substrate support structures, when it is necessary to vacuum dry the substrates, the drive devices 2 are controlled to drive the plurality of support rods 3 to move upward by the same distance until the plane in which the respective support discs 4 are located is higher than that in which the top ends of the respective support pins 1 are located. At this time, the substrates can be placed on the plane in which the respective support discs 4 are located. Since the support discs 4 are made of flexible material, it is possible to prevent the substrates from being scratched when the substrates slide on the support discs 4. After that, the drive devices 2 are controlled to drive the respective support rods 3 to move downward by the same distance. When the plane in which the respective support discs 4 are located is flushed with the plane in which the top ends of the respective support pins 1 are located, the substrates can smoothly contact the top ends of the respective support pins 1, thereby preventing the substrates from sliding on the top ends of the respective support pins 1, which in turn avoids the substrates from being scratched. Thereafter, the drive devices 2 continue to drive the respective support pins 1 to move downward until the plane in which the respective support discs 4 are located is lower than the plane in which the top ends of the respective support pins 1 are located. In this way, the support discs 4 can be prevented from contacting the substrates when the substrates are vacuum dried or baked, thereby avoiding poor quality and uneven brightness of the substrate due to a contact of the support discs 4 with any pixel region. After the substrates are vacuum dried, the drive devices 2 are controlled to drive each support rod 3 to move upward by the same distance. When the plane in which the respective support discs 4 are located is flushed with the plane in which the top ends of the respective support pins 1 are located, the support discs 4 are brought into contact with the substrates and allow the substrates to leave the top end of each support pin 1 smoothly, which prevents the substrates from sliding on the top end of each support pin 1, thereby avoiding the substrates from being scratched. Thus, the vacuum drying apparatus and the method for vacuum drying substrates by the same according to the embodiments of the disclosure can not only avoid the substrate from being scratched but also prevent poor quality and uneven brightness of the substrates.

The above description only relates to embodiments of the present application, and the scope of the present invention is not limited thereto. It would be appreciated by those skilled in the art that various changes or modifications may be made in these embodiments based on the disclosure herein without departing from the principle and spirit of the disclosure. Therefore, the scope of the invention should be defined by the claims and their equivalents.

What is claimed is:

1. A substrate support structure comprising:

a support pin having a top end for supporting a substrate; and an auxiliary support assembly including:

a drive device;

a support rod driven by the drive device; and a support disc disposed at a top end of the support rod and made of flexible material adapted to support the substrate, wherein the drive device is configured to drive the support rod to move in a direction parallel to an axial direction of the support pin so as to make the support disc positioned below or above the top end of the support pin as the support rod moves, so that the substrate is selectively supported by the support disc or the support pin.

2. The substrate support structure according to claim 1, wherein the support pin has a cavity therein, within which the drive device is disposed;

the support pin includes a side wall which is formed with an elongated slot penetrating the side wall radially and extending axially; and the support rod has a bottom end connected with the drive device, and a top portion of the support rod is extended out of the cavity through the elongated slot.

3. The substrate support structure according to claim 2, wherein the support rod includes a main rod and a plurality of branch rods, a bottom end of the main rod being connected with the drive device, and a top end of the main rod being connected with bottom ends of the plurality of branch rods;

the side wall of the support pin is formed with a plurality of the elongated slots corresponding to the plurality of branch rods, so that the plurality of branch rods are extended out of the cavity through the respective elongated slots, with top ends of the plurality of branch rods being located in a same plane; and the support disc includes a plurality of support discs, the plurality of support discs being disposed on the respective top ends of the plurality of branch rods.

4. The substrate support structure according to claim 3, wherein the plurality of branch rods are uniformly distributed in a circumferential direction of the main rod.

5. The substrate support structure according to claim 1, wherein the support disc includes a vacuum chuck connected with a vacuum generator, wherein when an adsorption surface of the vacuum chuck approaches a surface of the substrate, the vacuum generator draws off air between the adsorption surface of the vacuum chuck and the surface of the substrate so that vacuum is generated between the adsorption surface of the vacuum chuck and the surface of the substrate to adsorb the substrate, or the vacuum generator feeds air between the adsorption surface of the vacuum chuck and the surface of the substrate so that the vacuum therebetween is released to remove the substrate.

6. The substrate support structure according to claim 1, wherein the flexible material includes rubber.

7. The substrate support structure according to claim 1, wherein the top end of the support spin is formed in a cone shape.

8. The substrate support structure according to claim 1, further comprising a control system configured to control the drive device so as to drive the support rod to move upward or downward in the direction parallel to the axial direction of the support pin.

9. The substrate support structure according to claim 1, wherein the support disc is detachably connected to the top end of the support rod.

10. A vacuum drying apparatus comprising a support platform, a surface of which is provided with at least one substrate support structure according to claim 1.

11. The vacuum drying apparatus according to claim 10, wherein the support pin has a cavity therein, within which the drive device is disposed;

the support pin includes a side wall which is formed with an elongated slot penetrating the side wall radially and extending axially; and the support rod has a bottom end connected with the drive device, and a top portion of the support rod is extended out of the cavity through the elongated slot.

12. The vacuum drying apparatus according to claim 11, wherein the support rod includes a main rod and a plurality of branch rods, a bottom end of the main rod being connected with the drive device, and a top end of the main rod being connected with bottom ends of the plurality of branch rods;

the side wall of the support pin is formed with a plurality of the elongated slots corresponding to the plurality of branch rods, so that the plurality of branch rods are extended out of the cavity through the respective elongated slots, with top ends of the plurality of branch rods being located in a same plane; and the support disc includes a plurality of support discs, the plurality of support discs being disposed on the respective top ends of the plurality of branch rods.

13. The vacuum drying apparatus according to claim 12, wherein the plurality of branch rods are uniformly distributed in a circumferential direction of the main rod.

14. The vacuum drying apparatus according to claim 10, wherein the support disc includes a vacuum chuck connected with a vacuum generator, wherein when an adsorption surface of the vacuum chuck approaches a surface of the substrate, the vacuum generator draws off air between the adsorption surface of the vacuum chuck and the surface of the substrate so that vacuum is generated between the adsorption surface of the vacuum chuck and the surface of the substrate to adsorb the substrate, or the vacuum generator feeds air between the adsorption surface of the vacuum chuck and the surface of the substrate so that the vacuum therebetween is released to remove the substrate.

15. The vacuum drying apparatus according to claim 10, wherein the flexible material includes rubber.

16. The vacuum drying apparatus according to claim 10, wherein the top end of the support spin is formed in a cone shape.

17. The vacuum drying apparatus according to claim 10, further comprising a control system constructed to control the drive device to drive the support rod to move upward or downward in the direction parallel to the axial direction of the support pin.

18. The vacuum drying apparatus according to claim 10, wherein the support disc is detachably connected to the top end of the support rod.

19. A method for vacuum drying a substrate by the vacuum drying apparatus according to claim 10, comprising:

controlling the drive device of each substrate support structure to drive each support rod to move until the respective support discs are located in a same plane, which is above a plane in which the top ends of the respective support pins are located;

placing the substrate to be vacuum dried onto the support discs of each support structure;

controlling the drive device of each substrate support structure to drive each support rod to move downward by a same distance until the plane in which the respective support discs are located is below the plane in which the top ends of the respective support pins are located, such that the substrate to be vacuum dried falls on the top end of each support pin; and starting the vacuum drying apparatus to vacuum dry the substrate located on the top end of each support pin.

20. The method according to claim 19, wherein after starting the vacuum drying apparatus to vacuum dry the substrate located on the top end of each support pin, the method further comprises:

controlling the drive device of each substrate support structure to drive each support rod to move upward by a same distance until the substrate having been vacuum dried is lifted up by the support discs of the respective support structures; and removing the substrate having been vacuum dried.

* * * * *